US011192019B2

(12) United States Patent
Viera et al.

(10) Patent No.: US 11,192,019 B2
(45) Date of Patent: Dec. 7, 2021

(54) SKATEBOARD MODULAR ELECTRIC POWERTRAIN

(71) Applicant: Unlimited Engineering, SL, Barcelona (ES)

(72) Inventors: Juan P. Viera, Barcelona (ES); Alejandro Veloz, Barcelona (ES); Carlos Kubler, Barcelona (ES)

(73) Assignee: Unlimited Engineering, SL, Barcelona (ES)

( * ) Notice: Subject to any disclaimer, the term of this patent is extended or adjusted under 35 U.S.C. 154(b) by 275 days.

(21) Appl. No.: 16/318,771

(22) PCT Filed: Jul. 19, 2017

(86) PCT No.: PCT/IB2017/000975
§ 371 (c)(1),
(2) Date: Jan. 18, 2019

(87) PCT Pub. No.: WO2018/015805
PCT Pub. Date: Jan. 25, 2018

(65) Prior Publication Data

US 2019/0240563 A1 Aug. 8, 2019

Related U.S. Application Data

(60) Provisional application No. 62/363,871, filed on Jul. 19, 2016.

(51) Int. Cl.
*A63C 17/12* (2006.01)
*A63C 17/01* (2006.01)
*A63C 17/22* (2006.01)

(52) U.S. Cl.
CPC ..... *A63C 17/12* (2013.01); *A63C 17/012* (2013.01); *A63C 17/015* (2013.01); *A63C 17/226* (2013.01); *A63C 2203/12* (2013.01)

(58) Field of Classification Search
CPC .... A63C 17/12; A63C 17/226; A63C 2203/12
See application file for complete search history.

(56) References Cited

U.S. PATENT DOCUMENTS 3,985,418 A * 10/1976 Spinner ..... H01R 9/05 439/584
5,020,621 A * 6/1991 Martin ..... A63C 17/01 180/180

(Continued)

FOREIGN PATENT DOCUMENTS

WO WO 2009/124318 A1 10/2009

OTHER PUBLICATIONS

International Searching Authority/European Patent Office, International Search Report and Written Opinion of the International Searching Authority, Application No. PCT/IB2017/000975, dated Feb. 27, 2018, 14 pages.

*Primary Examiner* — James A Shriver, II
*Assistant Examiner* — Michael T. Walsh
(74) *Attorney, Agent, or Firm* — Sunstein LLP

(57) ABSTRACT

A modular motorized wheel system is provided for replacing a conventional wheel of a conventional skateboard. The wheel is retained on the axle of the skateboard by an end nut removably attachable to the outside end of the axle. The system includes a motor shaft having an axial bore therethrough. The bore is sized to make the motor shaft concentrically and removably mountable on the axle. The motor shaft has an exterior end formed in an open cylindrical shape, the exterior end including an axially displaced shoulder sized to receive and abut the end nut, by which the motor shaft is secured on the axle. Other embodiments are provided.

12 Claims, 20 Drawing Sheets

(56) References Cited

U.S. PATENT DOCUMENTS

| | | | | |
|---|---|---|---|---|
| 5,173,984 | A * | 12/1992 | Kaye | E03F 9/005 15/104.33 |
| 8,784,139 | B2 * | 7/2014 | Durand | G02B 6/4292 439/695 |
| 2005/0067207 | A1 * | 3/2005 | Radtke | B62M 6/75 180/223 |
| 2006/0145443 | A1 * | 7/2006 | Morris | A63C 17/12 280/87.01 |
| 2013/0206493 | A1 * | 8/2013 | Larson | A63C 17/012 180/181 |
| 2014/0196968 | A1 * | 7/2014 | Bieler | B62M 6/65 180/181 |
| 2014/0262574 | A1 * | 9/2014 | Rodgers | A63C 17/015 180/167 |
| 2016/0059108 | A1 * | 3/2016 | Demolder | A63C 17/12 701/22 |
| 2016/0067588 | A1 * | 3/2016 | Tan | B60L 15/00 180/181 |
| 2016/0144267 | A1 * | 5/2016 | Huang | A63C 17/12 180/181 |
| 2016/0158635 | A1 * | 6/2016 | Aders | A63C 17/015 180/65.1 |
| 2016/0184690 | A1 * | 6/2016 | Aders | A63C 17/01 180/20 |

* cited by examiner

DETAIL B

DETAIL C

SKATEBOARD MODULAR ELECTRIC POWERTRAIN

RELATED APPLICATION

The present application claims the priority from U.S. provisional application Ser. No. 62/363,871, filed Jul. 19, 2016, entitled "Skateboard modular electric powertrain." That related application is hereby incorporated herein by reference in its entirety.

TECHNICAL FIELD

The present disclosure relates to motorized wheels, and more particularly, to motorized wheels for use with personal transportation devices such as skateboards.

BACKGROUND ART

Conventional skateboards have been utilized for decades. A skateboard consists of a deck—often made out of plies of wood or hard-flexible material—on which the user stands. Attached underneath the deck are two trucks that feature an axle at both ends on which wheels are mounted. Trucks also have pivoting freedom which provides steering capabilities. Typical skateboards are human propelled: the user applies force to the ground to move forward in linear motion over the rolling skateboard.

The first electric skateboards where custom built by hobbyists, who modified the wheel and truck to be able to install an external electric motor that transmitted torque to the wheel through a belt-pulley system. Eventually, a few companies started offering this solution as commercial products. The belt-pulley system introduces frictional losses, noise, points of adjustment/maintenance, and greatly complicates the operation of the skateboard in free-rolling conditions where the electric drive is not powered. Later, a few others have implemented the direct-drive wheel-motor solution, but none of these solutions are mountable to any skateboard truck and with the conventional locknut. Some of them come in a two-motor arrangement with the complete truck and battery, while some others need modifications to the truck or even gluing the motor on for better torque transmission. All these solutions for adding electric propulsion to skateboards require modifications from the standard skateboard and are difficult to install. This also implies that it is difficult for the user to revert back to the standard skateboard if it is so desired.

Personal electric vehicles have gained acceptance and continue to transform the way humans transport themselves especially in dense urban areas. Personal electric vehicles utilize battery packs for energy storage, usually but not always fitted with stand-alone protection circuitry. There is a plethora of vehicles of different sizes and manufactures and all utilize different battery architectures thus battery systems are not usually interchangeable. Moreover, these battery packs do not communicate with the vehicle power driver or permit advanced power management features. Modifications or complicated wiring is needed to connect multiple battery packs in parallel.

A modular energy system is then beneficiary as it allows for the use of a single energy package in several applications such as light electric vehicles or personal energy storage.

SUMMARY OF THE EMBODIMENTS

In accordance with one embodiment of the invention, there is provided a motorized wheel system for replacing a conventional wheel of a conventional skateboard. In this embodiment, the skateboard has a truck with an axle on which is mounted the conventional wheel, the axle extending from an end of the truck so as to form a shoulder of the truck and having an outside end thereof. The wheel is retained on the axle by an end nut removably attachable to the outside end of the axle. In this embodiment, the system includes a motor shaft having an axial bore therethrough. The bore is sized to make the motor shaft concentrically and removably mountable on the axle. Additionally, the motor shaft has an exterior end formed in an open cylindrical shape, the exterior end sized to provide access to the outside end of the axle, the exterior end including an axially displaced shoulder sized to receive and abut the end nut, by which the motor shaft is secured on the axle. The embodiment additionally includes a coupler having an axial bore therethrough, positionable over the axle, having an interior face configured to abut the shoulder of the truck and an exterior face configured to be coupled to the motor shaft, wherein the coupler is shaped to transmit torque from the motor shaft to the truck; a stator assembly fixedly mounted concentrically around the motor shaft; a rotor assembly having a permanently magnetized housing rotatably mounted concentrically outside of the stator assembly; and a tire mounted concentrically outside of and coupled to the rotor assembly. These components are arranged so that (i) the motor shaft, stator assembly, and rotor assembly form components of a dc brushless motor; (ii) the wheel system is mountable on the truck axle of the conventional skate board by the end nut, and (iii) tightening the end nut secures mechanical coupling of the motor shaft to the truck axle through the coupler.

In a related embodiment, the coupler is a clamping cone having an axially disposed slit to allow for radial expansion and contraction of the cone, and the portion of the motor shaft abutting the coupler has a corresponding female conical cut to mate with the clamping cone, and the tightening of the end nut urges the motor shaft axially to force the corresponding female conical cut to engulf an increasing amount of the clamping cone and to urge the clamping cone axially against the truck shoulder while producing a radial force between the clamping cone and the truck axle.

In another related embodiment, the coupler is a compression washer.

In another related embodiment, the coupler is a toothed washer.

In yet another related embodiment, the coupler is a splined washer.

In a further embodiment, the motor shaft has an interior end formed in an open cylindrical shape, the interior end sized to fit over a portion of the truck abutting the truck shoulder and sized to provide an interior wall having clearance over common truck size ranges.

In another related embodiment, a motorized wheel system includes a first electronic controller coupled to the stator assembly, wherein the first electronic controller is configured to drive the stator assembly.

In yet another related embodiment, the first electronic controller is configured to drive the stator assembly via a three-phase connector.

In a related embodiment, a motorized wheel system according to claim 7, further comprising a first battery pack assembly, coupled to the first electronic controller and configured to provide power to the first electronic controller.

In another related embodiment, the first battery pack assembly comprises a battery management system coupled to a battery, the battery management system configured to monitor a charge level of the battery.

In yet another related embodiment, a motorized wheel system includes a bridge configured to couple a power signal, a data signal, or a combination of a power signal and data signal between the first electronic controller and first battery pack assembly.

In a further related embodiment, a motorized wheel system includes a second battery pack assembly coupled to the bridge, wherein the bridge is configured to couple a power signal, a data signal, or a combination of a power signal and data signal between the second battery pack assembly, the first electronic controller, and the first battery pack assembly.

In accordance with another embodiment of the invention, a method is provided for managing a set of battery packs configured to provide power to an electronic controller of a motorized wheel system of a skateboard, the set of battery packs coupled to a battery management system. The method includes determining, by the battery management system, a number of battery packs coupled to the motorized wheel system, wherein if the number of batteries is equal to one, transmitting, by the battery management system, a first signal to turn on a power port of the one battery pack, and if the number of batteries is greater than one, determining, by the battery management system, a charge level of each of the battery packs of the set of battery packs. If the charge level of a first one of the set of battery packs is greater than the charge level of a second one of the set of battery packs, the method includes transmitting, by the battery management system, a second signal to turn off a power port of the second battery pack, and a third signal to turn on the power port of the first battery pack and a third signal to turn off a power port of the second battery pack, and if the charge level of the first battery pack is less than the charge level of the second battery pack, the method includes transmitting, by the battery management system, a fourth signal to turn off the power port of the first battery pack and a fifth signal to turn on a power port of the second battery pack. If the charge level of the first battery pack is approximately equal to the charge level of the second battery pack, the method includes transmitting, by the battery management system, a sixth signal to turn on the power ports of the first and second battery packs.

In accordance with another embodiment of the invention, a battery pack-controller system is provided for use with a personal transportation vehicle, the personal transportation vehicle having at least one motorized wheel powered and controlled by the battery pack-controller system. The battery pack-controller system includes a bridge configured to connect components selected from a group consisting of a set of battery packs, a set of electronic controllers, and combinations thereof, the bridge comprising a plurality of connector ports, wherein each connector port is configured to couple (i) a power signal, (ii) a control signal, or (iii) both the power signal and the control signal. The system further includes a set of battery pack assemblies, each battery pack assembly of the set of battery pack assemblies comprising a battery management system coupled to one or more battery cells and a first connector port configured to output a power signal according to a charge level of the one or more battery cells, the first connector port configured to connect to one of the plurality of connector ports of the bridge, wherein use range of the personal transportation vehicle is configured to be extended by each additional battery pack assembly connected to the bridge. Additionally, the system includes a set of electronic controllers, coupled to the set of battery pack assemblies and comprising (i) a second connector port configured to couple to the first connector port and (ii) a wired connector configured to transmit a control signal to the at least one motorized wheel, the second connector port configured to connect to one of the plurality of connector ports of the bridge.

In accordance with another embodiment of the invention, a battery pack-controller system is provided for use with a personal transportation vehicle, the personal transportation vehicle having at least one motorized wheel powered and controlled by the battery pack-controller system. The battery pack-controller system includes a bridge configured to connect components selected from a group consisting of a set of battery packs, a set of electronic controllers, and combinations thereof, the bridge comprising a plurality of connector ports, wherein each connector port is configured to couple (i) a power signal, (ii) a control signal, or (iii) both the power signal and the control signal. The system further includes a set of battery pack assemblies, each battery pack assembly of the set of battery pack assemblies comprising a battery management system coupled to one or more battery cells and a first connector port configured to output a power signal according to a charge level of the one or more battery cells, the first connector port configured to connect to one of the plurality of connector ports of the bridge, wherein use range of the personal transportation vehicle is configured to be extended by each additional battery pack assembly connected to the bridge. Additionally, the system includes a set of electronic controllers, coupled to the set of battery pack assemblies and comprising (i) a second connector port configured to couple to the first connector port and (ii) a wired connector configured to transmit a control signal to the at least one motorized wheel, the second connector port configured to connect to one of the plurality of connector ports of the bridge.

In a related embodiment, the personal transportation vehicle is a skateboard having a board and two trucks mounted on a surface of the board, wherein the battery-pack controller system is shaped and sized to fit on the surface of the board.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

The "end nut" of an axle of a conventional skate board is a nut that threads onto an outside end of the axle for retaining a wheel on the axle. The end nut is typically a lock nut, although other implementations are possible, wherein, for example, the end nut is a castellated nut (sometimes called a "spindle nut") that is configured to receive a cotter pin (sometimes called a "split pin") that also fits through a hole drilled through a diameter of the axle.

A "set" includes at least one member.

Disclosed herein are exemplary embodiments of an improved direct-drive electric propulsion system, based on a motorized wheel concept that mounts onto any conventional skateboard truck axle while also utilizing the conventional end nut, which is often a locknut. An exemplary motorized wheel features a replaceable synthetic rubber tire which makes contact with the ground. The tire is held in place by a locking mechanism, such as a flange held by bolts or a snap ring. The motor shaft is configured to transmit torque to the truck via a torque coupling configuration such that when the motor is clamped in place by the conventional locknut, the clamping force produces friction between the truck and the motor shaft that can be utilized to transmit torque.

Disclosed further herein are exemplary embodiments of a modular energy package for light electric vehicles. The exemplary modular energy package can include a battery pack, protection circuitry, a shared power rail, and communications bus. The exemplary shared architecture allows for two or more battery packs to be connected in parallel and two or more controllers to drive independent motors. Inter-battery communication allows for efficient and safe operation of two or more battery packs in parallel arrangements. Such a battery pack configuration can allow independent powering of controllers or operation as parallel-connected battery packs. In an embodiment, a single battery pack assembly or multiple battery pack assemblies can communicate with a single controller or multiple controllers. The reconfigurable nature of the modular energy package provides for efficient management of the available power.

Motorized Wheel(s) for Personal Transportation Vehicle

Figure 1:
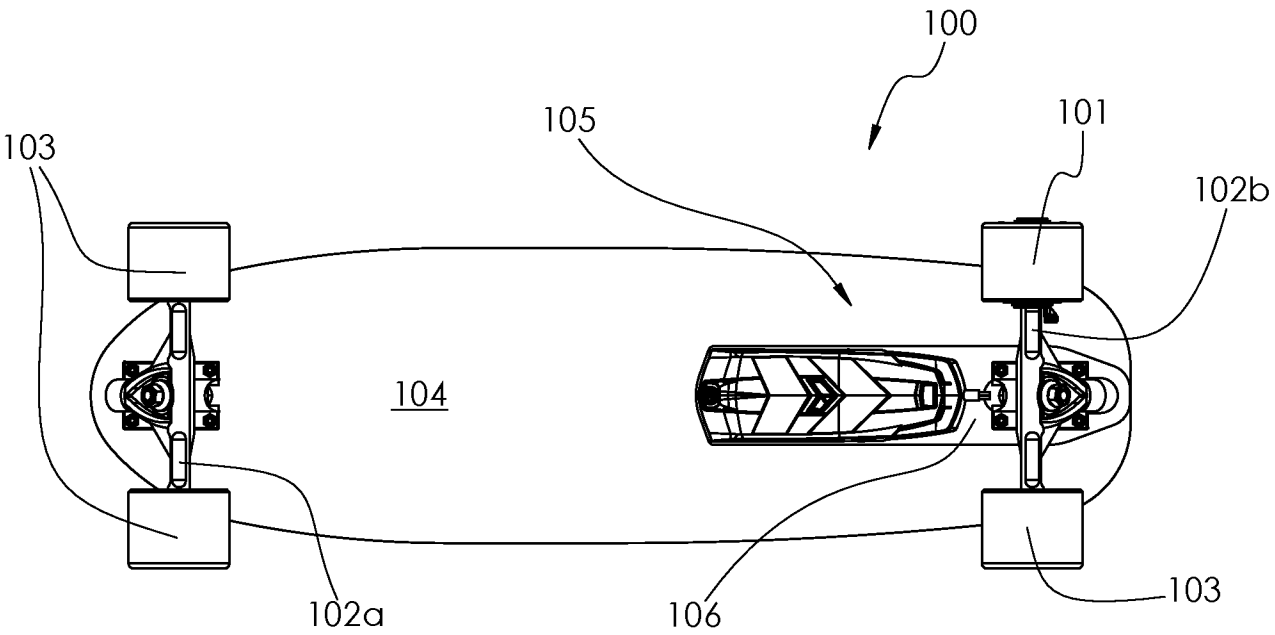
FIG. 1 is a bottom view of an exemplary assembled skateboard having a modular electric drivetrain configured in a single-motor setup in accordance with an embodiment of the present invention.
Figure 2:
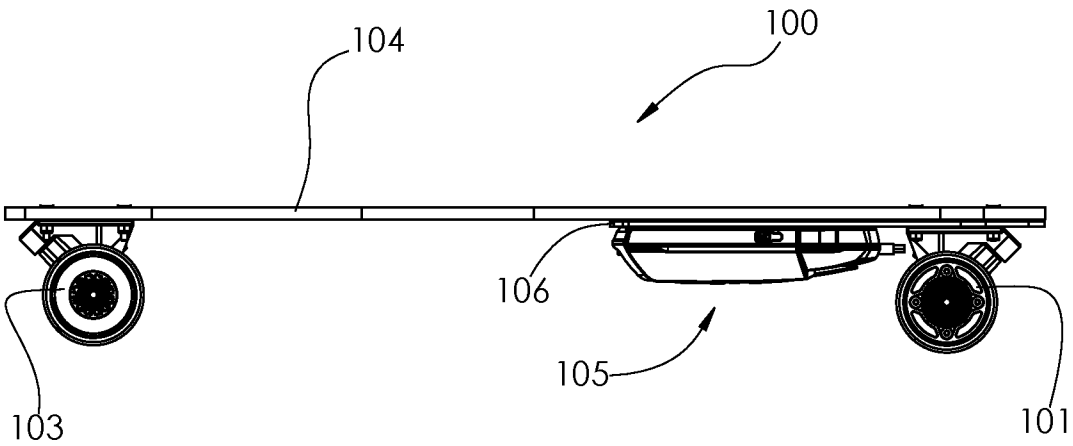
FIG. 2 is a side view of the exemplary assembled skateboard of FIG. 1.

FIG. 1 is a bottom view of an exemplary assembled skateboard having a modular electric drivetrain configured in a single motorized wheel configuration, while FIG. 2 is a side view of the exemplary assembled skateboard of FIG. 1. The exemplary skateboard 100 includes a board 104 (often made of wood) onto which two trucks 102*a* and 102*b* are bolted. In an exemplary embodiment, the trucks 102*a* and 102*b* have axles with standard diameter (e.g., approximately 8 mm) which are threaded near the ends with standard 5/16"−24 tpi UNF threads. The exemplary assembled skateboard 100, having a single-motor electric drivetrain, includes a wheel-motor 101 that replaces one of the standard wheels 103. The exemplary powerpack assembly 105 (which includes at least one battery pack assembly and at least one controller assembly) is mounted to the carrying backplate 106, which is fastened in place with the same bolts that hold the rear truck 102*b* to the board 104.

Figure 3:
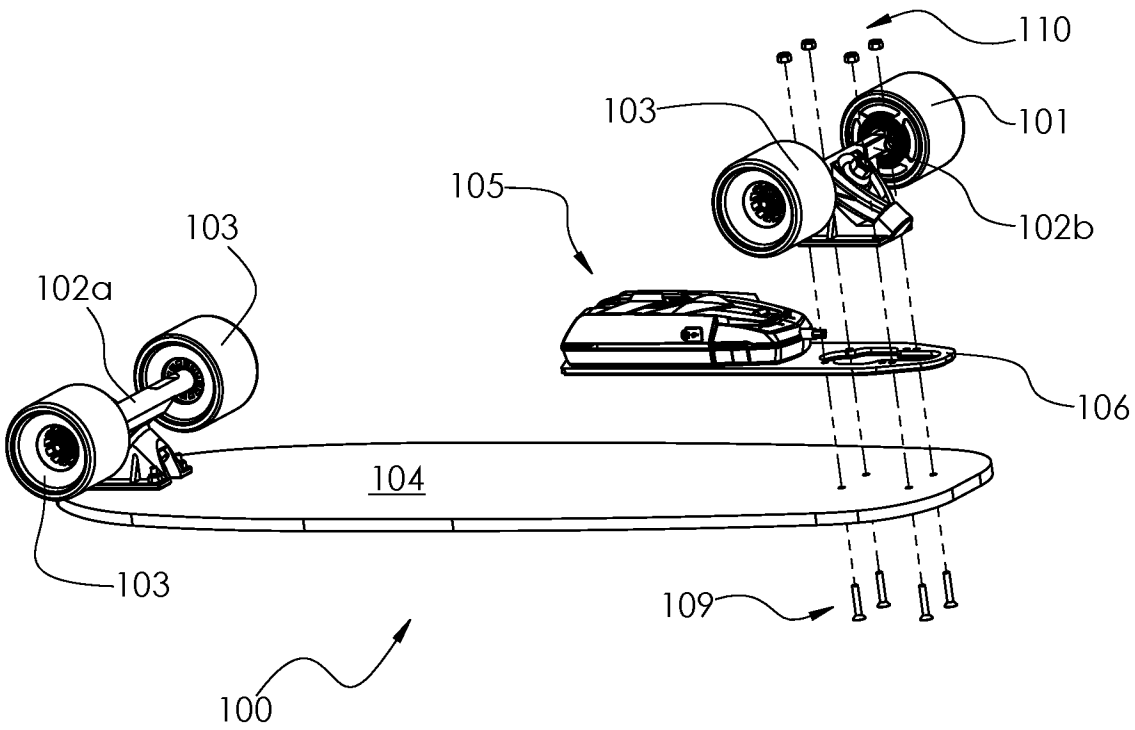
FIG. 3 is an exploded view of the exemplary single-motor skateboard assembly of FIG. 1, illustrating the modular electric powertrain configuration.

FIG. 3 is an exploded view of the exemplary single motorized wheel skateboard assembly presented in FIG. 1, illustrating the modular electric powertrain configuration. The powerpack assembly 105 is secured to the backplate 106, which is fastened to the board with the same bolts 109 that secure the rear truck 102*b* to the board 104. The ends of bolts 109 are secured with locknuts 110. In some embodiments, optional washers, placed on the bolts 109, can be utilized to distribute the clamping force of each bolt 109 and act as bearing surfaces while securing the backplate 106 and truck to the board 104. The washers can also act as bearings for the locknuts 110 when the latter are being tightened.

Figure 4:
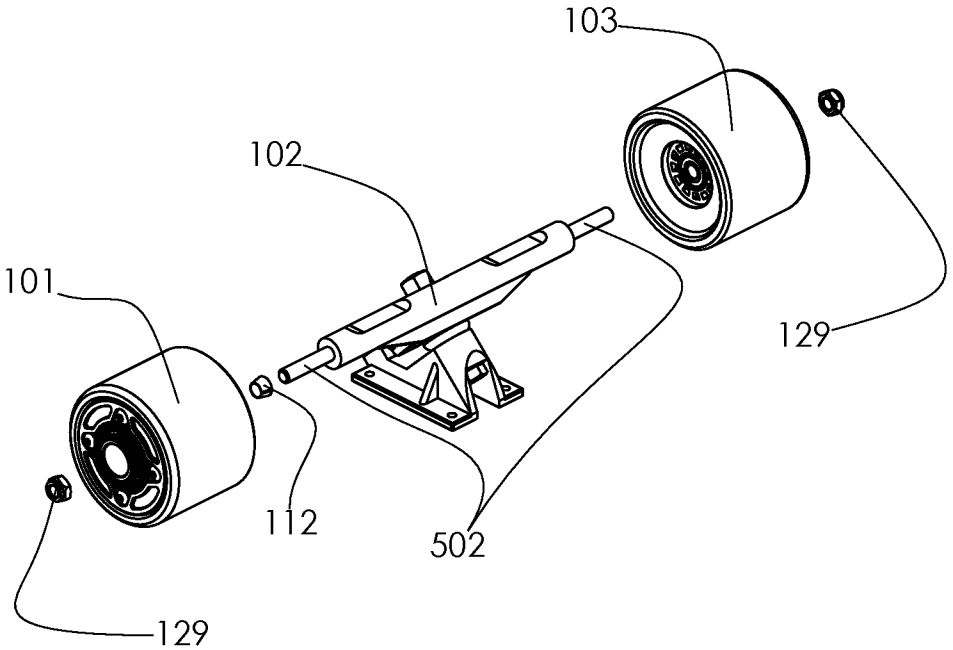
FIG. 4 is an exploded view of the exemplary truck-wheel assembly of FIG. 1 in a single-motor setup, illustrating the employment of a conventional locknut with a novel clamping cone.

FIG. 4 is an exploded view of an exemplary truck-wheel assembly of FIG. 1 in a single motorized wheel configuration illustrating the employment of an end nut, which is here implemented as a conventional locknut 129, to secure the wheel-motor 101 to the truck 102. This advantageous implementation allows a user to install the wheel-motor 101 to a skateboard by removing a locknut 129 and one of the original wheels, slide the wheel-motor 101 onto the free axle, and secure the wheel-motor 101 with the conventional locknut 129. The exemplary wheel-motor 101 utilizes a novel clamping cone 112 (made, for example, of metal) to grip the axle 502 protruding from the truck 102 and wedge into the wheel-motor 101 so as to allow the latter to provide torque relative to the axle 502. The exemplary clamping cone (described in further detail in connection with FIGS. 6-8) engages with a correspondingly shaped female conical cut in the wheel-motor 101. As the locknut 129 is tightened on the axle 502 protruding from the truck 102, the female conical cut moves axially toward the clamping cone 112 and forces the clamping cone 112 against a shoulder of the axle and causes compression of the clamping cone around the axle 502. The clamping cone 112 has an axially disposed slit (shown as item 802 in FIG. 8), the width of which decreases to accommodate compression of the clamping cone. As the clamping cone 112 is compressed, it securely grips the axle it surrounds.

Figure 5:
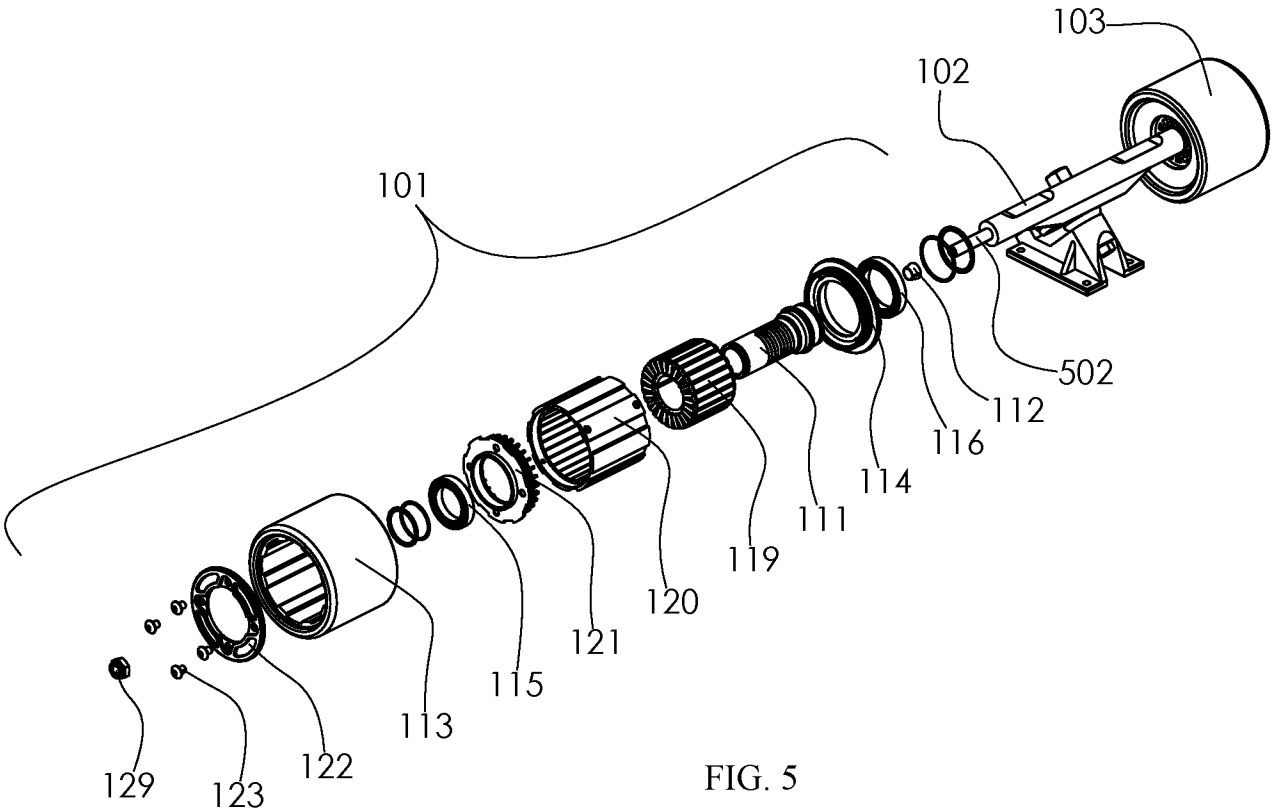
FIG. 5 is an exploded view of the wheel-motor assembly 101 of FIG. 4, including the truck, the electrically powered wheel, and the mounting system.

FIG. 5 is an exploded view of the exemplary wheel-motor assembly 101 of FIG. 4, including the truck, the electrically powered wheel, and the mounting system. In some embodiments, the wheel-motor 101, is configured as a three-phase DC brushless motor, and is structurally supported on a motor shaft 111. In some embodiments, the motor shaft 111 can be formed in a single piece or be formed in two pieces. The motor shaft 111 itself has an axial bore therethrough, so that the motor shaft 111 can be placed concentrically on the truck axle 502, and secured to the truck by the locknut 129. The stator 119, which includes copper windings to produce the magnetic field necessary to create torque, is mounted onto the motor shaft 111 in a fixed manner. Inner bearings 116 and outer bearings 115 allow for relative rotation between the stator 119 and the rotor assembly. The rotor assembly includes a permanently magnetized housing 120, the inner cover 114, and outer cover 121. The tire 113 can be made of a synthetic rubber exterior. A spline formed on the inner diameter of the tire mates with a corresponding spline on the exterior of the housing 120. This configuration enables torque to be transmitted between the tire and the housing. In some embodiments, the tire 113 can be mounted on a hub made of harder material. The hub can have a spline formed on its inner surface such that it may mate with a corresponding spline on the exterior of the housing. A flange 122, axially clamped with bolts 123, secures the tire 113 to the motor on which it is mounted. The motor assembly 101 is mounted onto the truck 102 by sliding it over the truck axle 502 and locking it in place with the conventional locknut 129.

Figure 6:
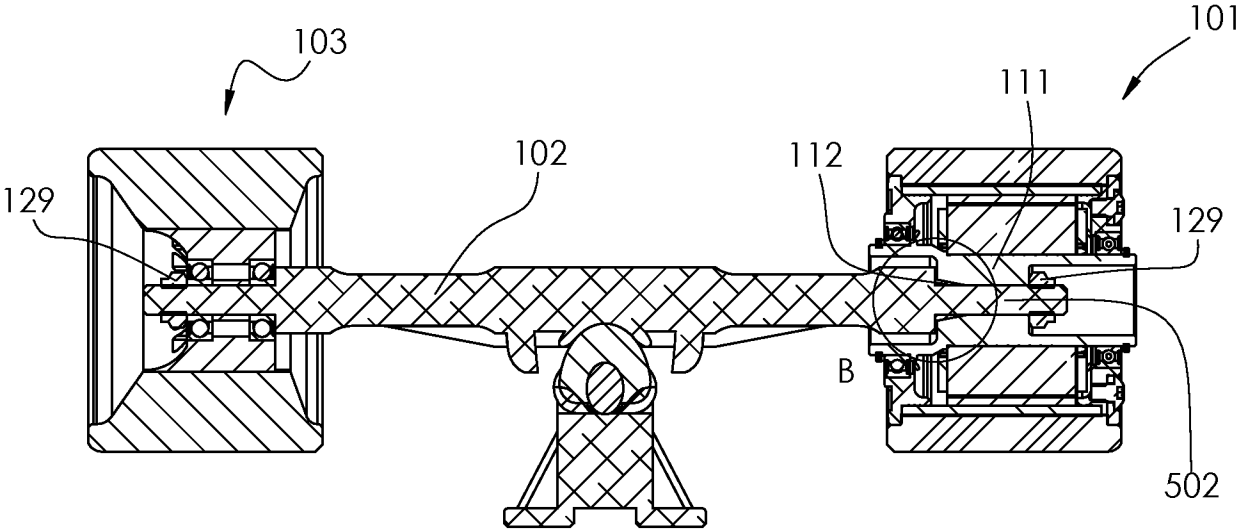
FIG. 6 is a vertical section of the exemplary truck-wheel assembly of FIG. 1, illustrating the position of the wheel-motor on a conventional truck utilizing the conventional locknut and the position of the clamping cone between the truck and the motor shaft.
Figure 7:
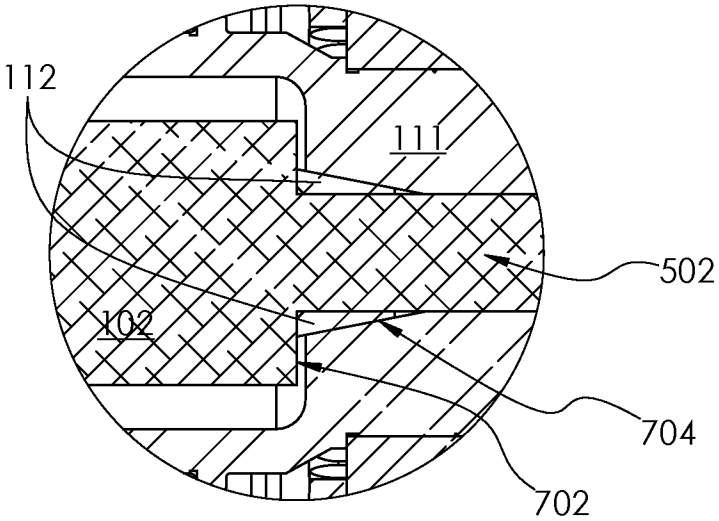
FIG. 7 is a detailed view of the exemplary clamping cone of FIG. 6 positioned between the motor shaft and truck.

FIG. 6 is a vertical section of the exemplary truck-wheel assembly of FIG. 1, illustrating the position of the wheel-motor 101 on a conventional truck 102 utilizing the conventional locknut 129 and the position of the clamping cone 112 between a shoulder of the truck 102 and the motor shaft 111. The detailed view presented in FIG. 7 shows the clamping cone 112 positioned on the axle 502 abutting the truck shoulder 702 and fitting into and engaging with the corresponding female conical cut 704 of the motor shaft 111. During tightening of the locknut 129, the axial force produced by the locknut 129 urges the motor shaft 111 axially, and forces the corresponding female conical cut 704 to engulf an increasing amount of the clamping cone 112 and to urge the clamping cone axially against the truck shoulder 702. As discussed previously, as the female conical cut 704 receives an increasing amount of the clamping cone 112, the width of the slit 802 (in FIG. 8) in the clamping cone is reduced to accommodate the reduced size of the clamping cone, and the clamping cone's decreased dimension produces a radial force between clamping cone 112 and the truck axle 502, which causes the clamping cone to grip the axle firmly. With the motor 101 thus locked in place, the motor can exert torque on the tire relative to truck axle and thus propel the skateboard. Because the clamping cone 112 is of spring material, it expands once the locknut 129 is loosened, and the slit 802 (shown in FIG. 8) in the clamping cone 112 becomes larger, so that the clamping cone can be easily removed if so desired.

Figure 8:
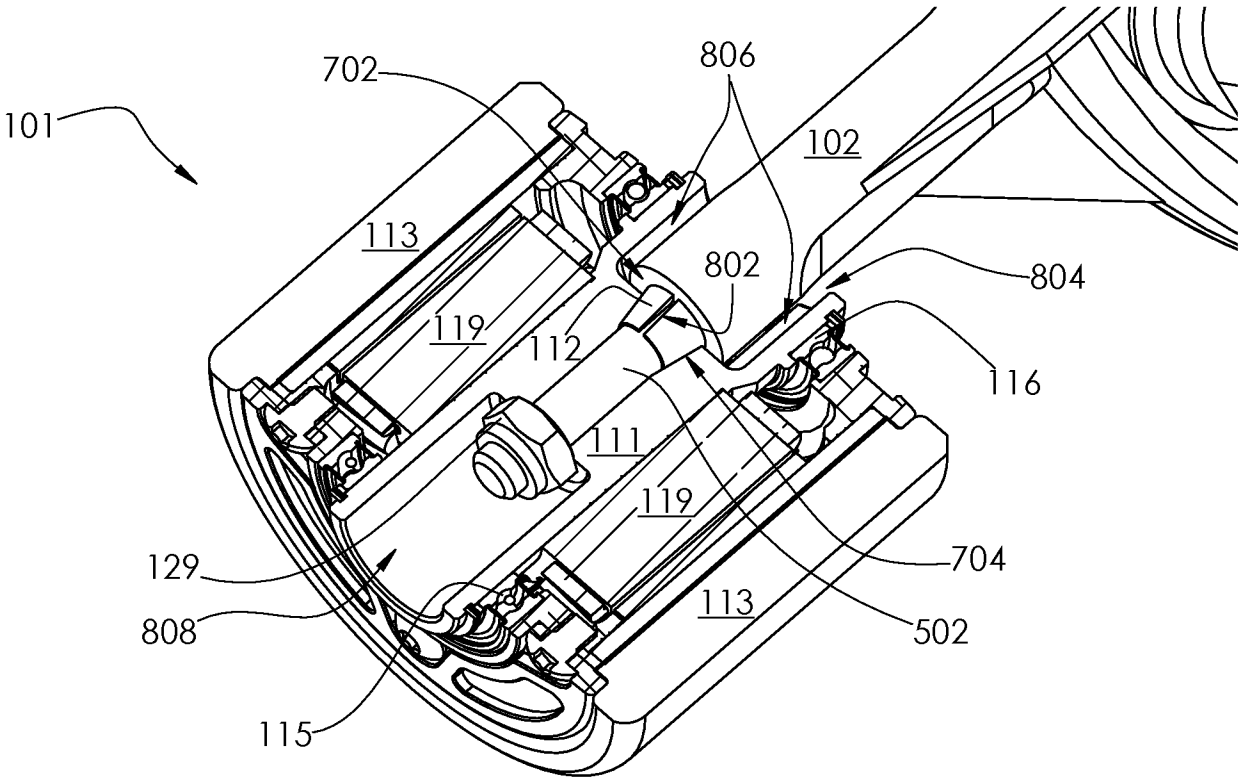
FIG. 8 is an isometric-sectional view of the exemplary truck-wheel assembly of FIG. 1, providing further detail beyond FIG. 7.

FIG. 8 is an isometric-sectional view of the exemplary truck-wheel assembly of FIG. 1, providing further detail beyond FIG. 7. In this view, there can be clearly seen the locknut 129, the clamping cone 112, the slit 802 in the clamping cone, the motor shaft 111, the female conical cut 704 in the motor shaft 111, the truck axle 502, and the truck shoulder 702. In an exemplary embodiment, the shaft 111 includes an interior end 804 with a clearance 806 that is configured to accommodate trucks 102 having a wide range of shapes and dimensions. This clearance 806 allows a user to install the wheel-motor 101 on multiple truck 102 types available in the market. The shaft 111 includes an exterior end 808 with an open cylindrical shape, which promotes easy and secure installation of the locknut 129 onto the axle 502.

Figure 9:
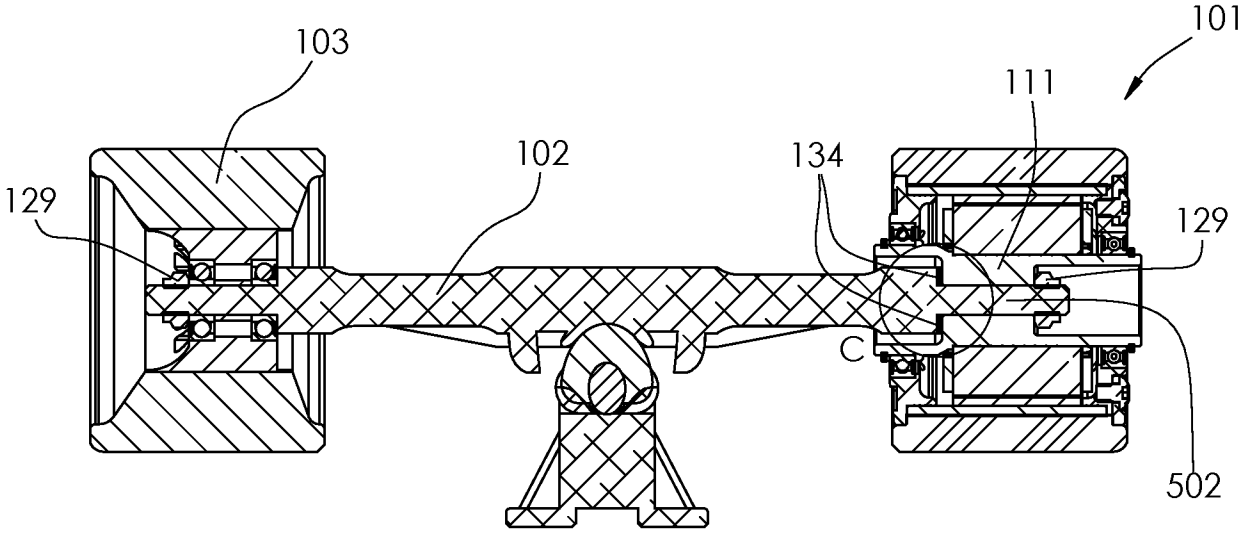
FIG. 9 is a vertical section of an embodiment of a truck-wheel assembly in accordance with the present invention, similar to that of FIG. 6, but with a compression washer instead of a clamping cone.
Figure 10:
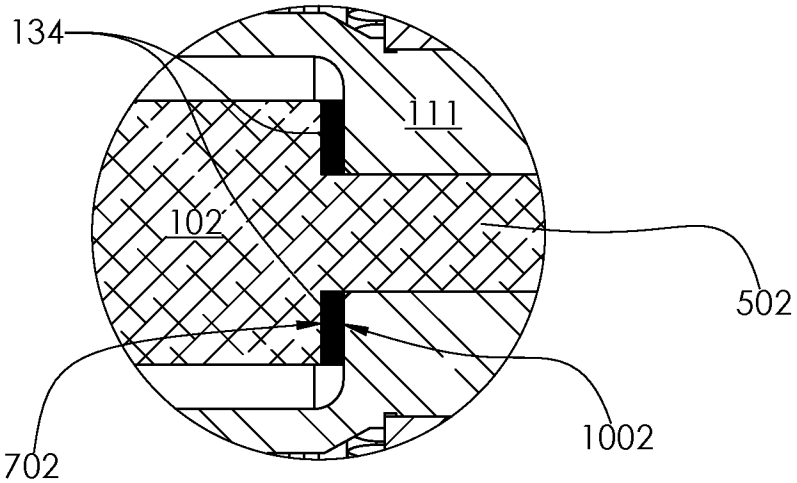
FIG. 10 is a detailed view of FIG. 9 showing the exemplary compression washer positioned between the truck shoulder and the motor shaft end face.

FIG. 9 is a vertical section of an embodiment of a truck-wheel assembly in accordance with the present invention, similar to that of FIG. 6, but with a compression washer 134 instead of the clamping cone 112. In this embodiment, the torque transmission coupling is accomplished through a compression washer 134 (shown in black shading) located between the motor shaft 111 and the truck shoulder 702 (shown in greater detail in FIG. 10). In this embodiment, inner end face 1002 of the motor shaft 111 is flat. The axial force produced by the conventional locknut 129 on the wheel-motor 101 is transmitted through the motor shaft 111 to end face 1002, which abuts the compression washer 134 and forces it against the truck shoulder 702, resulting in a friction force, at the interface between the compression washer 134 and the truck shoulder 702, which is utilized for torque transmission. In other related embodiments, torque transmission can be achieved without the compression washer 134, wherein the frictional force results from the axial force of end face 1002 directly against truck shoulder 702. In other related embodiments, the compression washer 134 or the clamping cone 112 is replaced by a a toothed washer (having radially oriented teeth that project at least somewhat axially), or a splined washer, or any other coupler having a desired shape configured to transmit torque from the wheel-motor 101 (more specifically, the motor shaft 111) relative to the truck 102.

Powerpack Assembly

Figure 11:
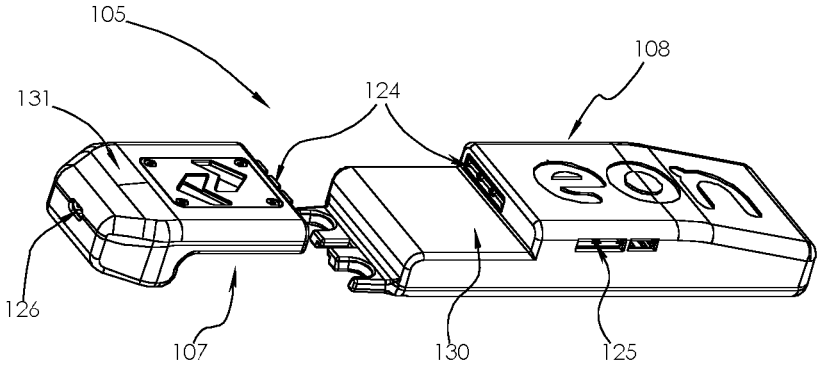
FIG. 11 is an isometric-exploded view of the exemplary powerpack assembly 105 of FIG. 1, including an exemplary controller assembly and battery pack assembly.

FIG. 11 is an isometric-exploded view of an exemplary powerpack, including an exemplary controller assembly 107 and battery pack assembly 108, which are removably coupled for both mechanical and electrical connectivity. The controller assembly 107 includes an electronic speed controller (ESC) and the battery pack assembly includes a battery management system (BMS). The ESC-BMS connector 124 provides communication between the BMS circuit (inside its protective housing 130 in the battery pack assembly 108) and the ESC circuit (inside a protective housing 131 of the control assembly 107). The three-phase connector 126 provides an outlet for connection to wires coupled to the wheel-motor main three-phase power wires. In an exemplary embodiment, a set of power rail connectors 125 provide for communication between one or more other fully assembled powerpacks 105. Alternatively or in addition, the power rail connectors 125 provide communication between the powerpack 105 and one or more other battery packs 108. Alternatively, the power rail connectors 124 provide communication directly between the battery pack 108 and one or more other battery packs 108.

Figure 12:
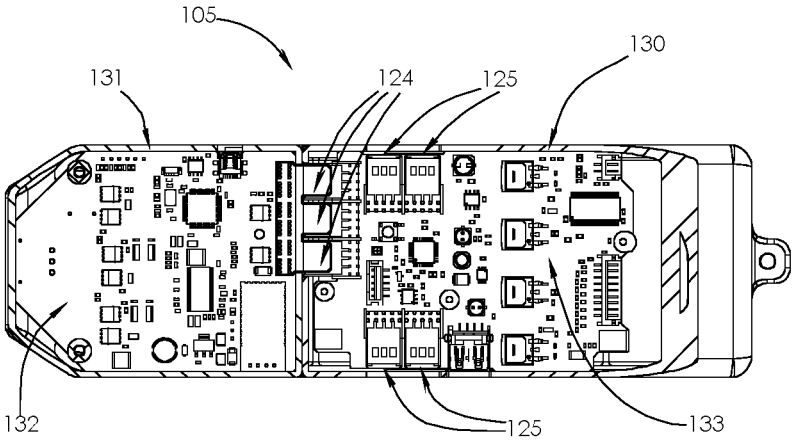
FIG. 12 is a sectional view of the exemplary powerpack assembly of FIG. 11 illustrating the modular architecture and the connection between an exemplary controller assembly and an exemplary battery pack assembly.

FIG. 12 is a sectional view of the exemplary powerpack assembly illustrating the modular architecture, the shared power rail connectors 125, and the connection 124 between the controller assembly 107 and the battery pack assembly 108. The ESC circuit 132 and the BMS circuit 133 are held inside protective housings 131 and 130 respectively. The housings 130, 131 can be made of injection molded plastic, machined metal, composite materials, or any other rigid and resistant material.

Figure 13:
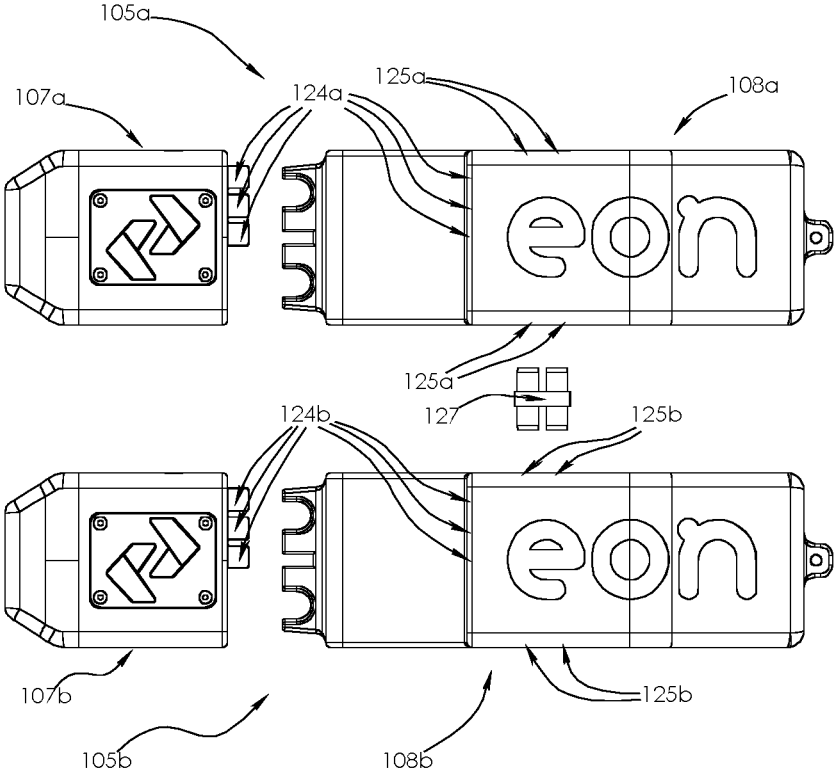
FIG. 13 is a top-exploded view of a pair of the exemplary powerpack assemblies, each similar to the assembly 105 of FIG. 1, wherein the pair of assemblies is configured, in accordance with an embodiment of the present invention, as a dual-powerpack modular assembly including a bridge connector.

FIG. 13 is a top-exploded view of a pair of the exemplary powerpack assemblies, wherein the pair of assemblies is configured, in accordance with an embodiment of the present invention, as a dual-powerpack modular assembly including a bridge connector 127. The modular architecture allows for an arrangement of two or more powerpacks 105*a*, 105*b* or two or more battery packs 108*a*, 108*b* to be connected in parallel. In this embodiment, the powerpack 105*a*, which includes the controller assembly 107*a* and the battery pack assembly 108*a*, is connected to the powerpack 105*b* through the bridge connector 127. The bridge connector 127 couples the two inner power rail connectors 125*a* and 125*b*. In some embodiments, more than two powerpacks can be communicably coupled.

Figure 14:
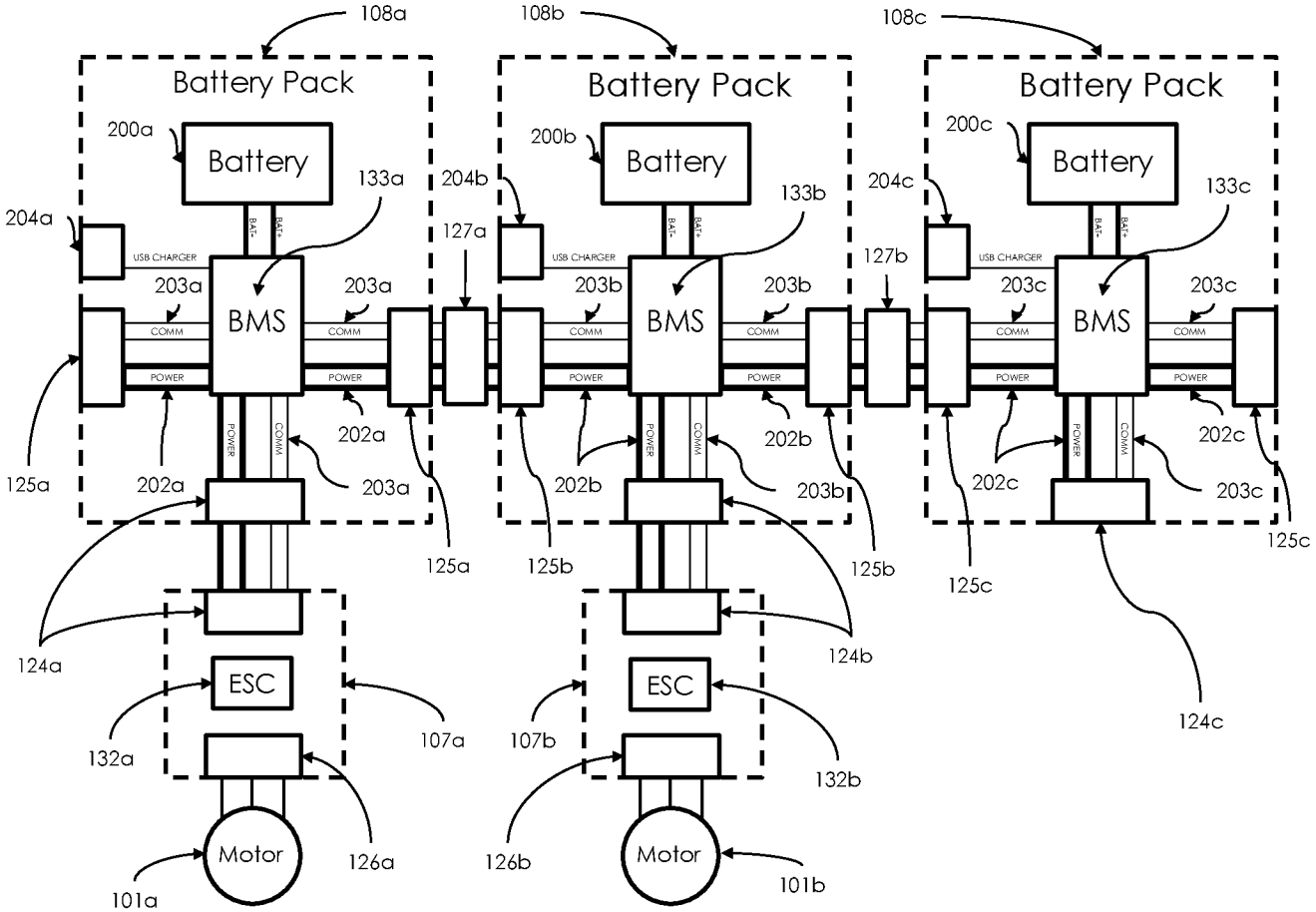
FIG. 14 is a schematic of an exemplary multi-powerpack modular architecture in accordance with an embodiment of the present invention.

FIG. 14 is a schematic of an exemplary multi-powerpack modular architecture. Each exemplary battery pack assembly 108 includes a battery 200, a BMS 133, and a main connector 124. In some embodiments, each battery pack 108 can have a universal serial bus (USB) charging port 204. The connector ports 124 connect a battery pack assembly 108 to a controller assembly 107 to communicate power (via a power bus 202) and/or data (via a communication bus 203). In some embodiments, each battery pack assembly 108 can have one or more connector ports 125 to connect to another battery pack assembly 108 to communicate power (via a power bus 202) and/or data (via a communication bus 203). In an exemplary embodiment, a bridge connector 127 couples connector ports 125 of two battery pack assemblies. Bridge connector 127 may feature a power bus 202 and a communication bus 203. The communication bus 203 enables a handshake procedure between two assemblies. Communication between two battery pack assemblies can be advantageous, for example, when two or more battery packs 108 with different state of charge are connected together. The battery pack assemblies can be coordinated to prevent excessive current flow between batteries 200. In some embodiments, BMS 133 can protect the battery 200 in case of short circuit, over-voltage, under-voltage, and/or abnormal current consumption. The exemplary modular architecture enables the connection of n motors 101 with n ESCs 132 and m battery packs 108 as long as m≥n.

Modular Architecture

In many instances, a user of a motorized personal transportation vehicle may want to change the power and/or range of the vehicle over time. Further, the user may be limited in the amount of funds available at any given time to increase the power and/or range of the vehicle. Thus, a modular architecture allows for the user to add components as funds are available or as they desire. As a first example, a user may first use a first wheel-motor 101, a first controller assembly 107, and a first battery pack assembly 108 to outfit his or her vehicle. In another example, the user may add a second battery pack assembly 108 (according to the embodiments disclosed herein) to the existing configuration to increase the range in use time. In another example, the user may add a second wheel-motor 101 and a second controller assembly 107 to the first example system, resulting in a system with two wheel-motors 101, two controller assemblies 107, and a first battery pack assembly 108. This configuration may increase the power to the personal transportation vehicle but may decrease the range. In yet another example, the user may add a second wheel-motor 101 and second controller assembly 107 to the previous configuration, resulting in two wheel-motors 101, two controller assemblies 107, and two battery pack assemblies 108. In some embodiments, the user has the option to customize the system with as many wheel-motors 101, controller assemblies 107, and/or battery pack assemblies 108 as needed for a particular motorized personal transportation vehicle. Note that the user also has the option to remove a battery pack assembly 108 and/or wheel-motor/controller assembly to decrease weight, range, and/or power. Further, the user is enabled to replace batteries on a personal transportation vehicle "on-the-go" for extended range. For example, the user may carry a backup battery pack assembly with charge to extend the use time of a powerpack having a single battery pack assembly 108.

Figure 19:
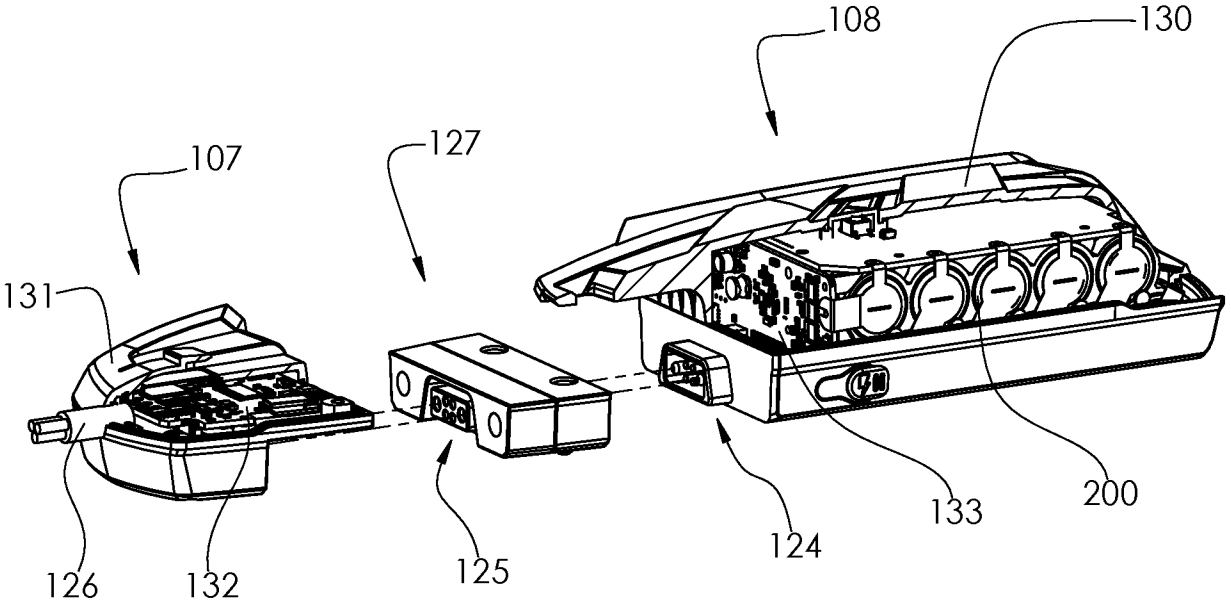
FIG. 19 is an isometric-sectional view of an exemplary powerpack including a battery pack assembly (similar to the assembly of FIG. 15), a controller assembly (each similar to the assembly of FIG. 16), and bridge, all in accordance with an embodiment of the present invention.

FIG. 19 is an isometric-sectional view of an exemplary powerpack including a battery pack assembly 108, a controller assembly 107, and bridge 127. Note that an array of battery cells 200 is coupled to BMS circuit 133. In some embodiments, the array of battery cells can include one or more battery cells. The power and/or data from the BMS are coupled to the ESC 132 in the controller assembly 107 via the bridge 127.

Figure 15:
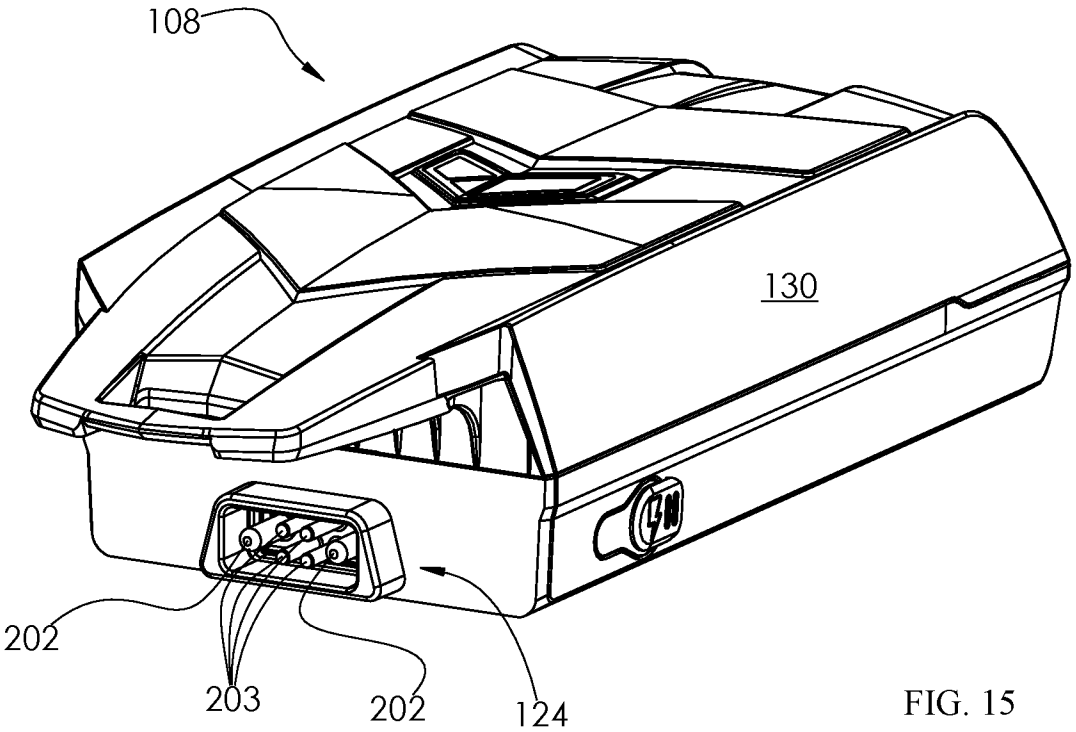
FIG. 15 is an isometric view of an exemplary battery pack assembly in accordance with an embodiment of the present invention.

FIG. 15 is an isometric view of an exemplary battery pack assembly 108. The battery pack assembly 108 includes housing 130 shaped to fit under, for example, a skateboard. The assembly 108 includes a connector port 124 which includes two or more pins 202 for power and one or more pins 203 for communication. These pins can be connected into a bridge 127 to provide power and/or data to other battery pack assemblies or controller assemblies, as discussed further herein.

Figure 16:
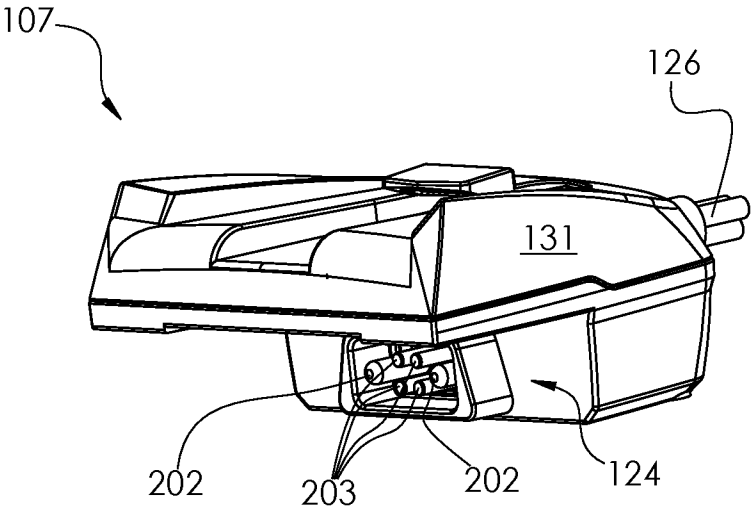
FIG. 16 is an isometric view of an exemplary controller assembly in accordance with an embodiment of the present invention.

FIG. 16 is an isometric view of an exemplary controller assembly 107. The assembly 107 includes housing 131, ESC 132, and three phase wires 126. The assembly 107 further includes a connector port 124 with at least two pins 202 for power and at least one pin 203 for communication. These pins can be coupled into the bridge 127 communicate power and data with battery pack assemblies 108 or controller assemblies 107.

Figure 17:
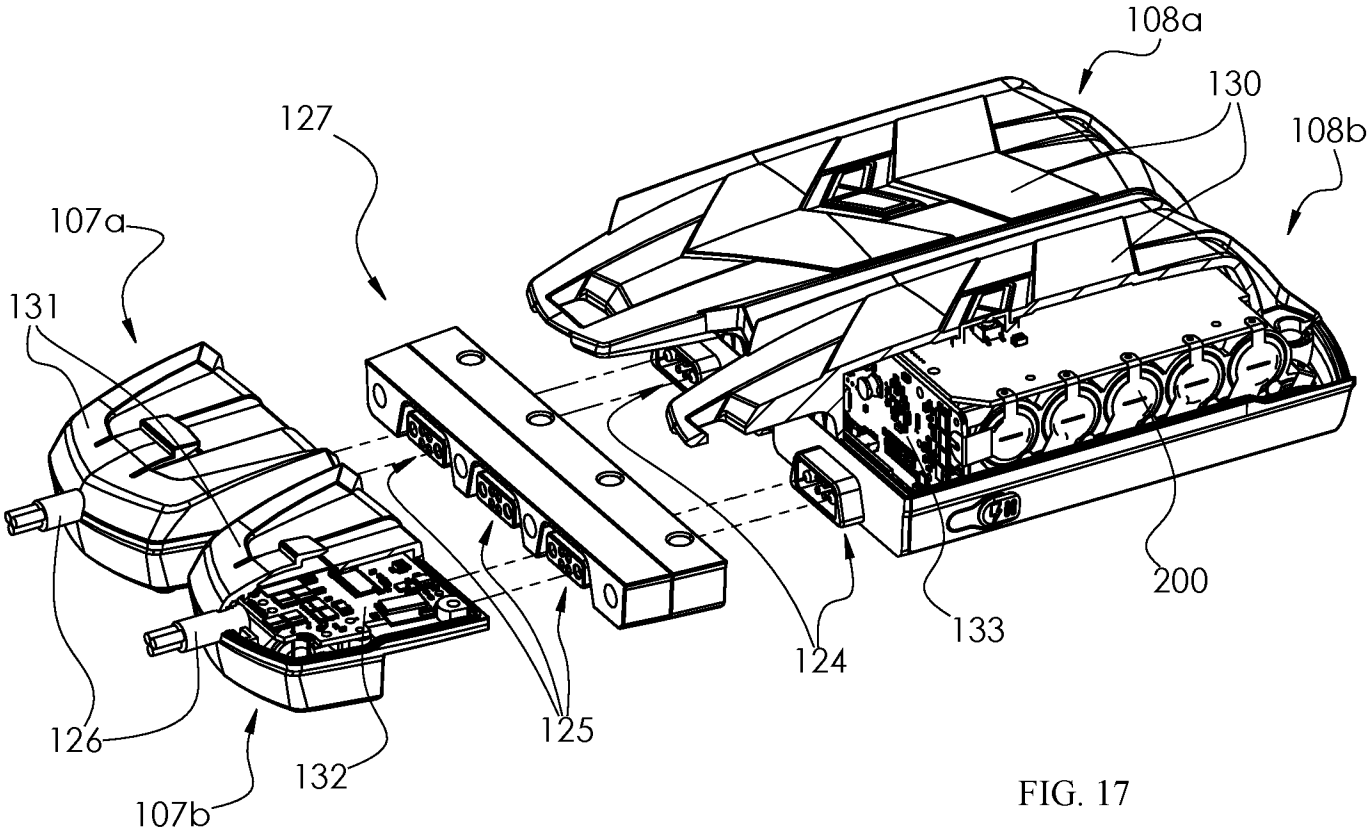
FIG. 17 is an isometric-sectional view of an exemplary powerpack including two battery pack assemblies (each similar to the assembly of FIG. 15), two controller assemblies (each similar to the bridge of FIG. 16), and a bridge, all in accordance with an embodiment of the present invention.
Figure 18:
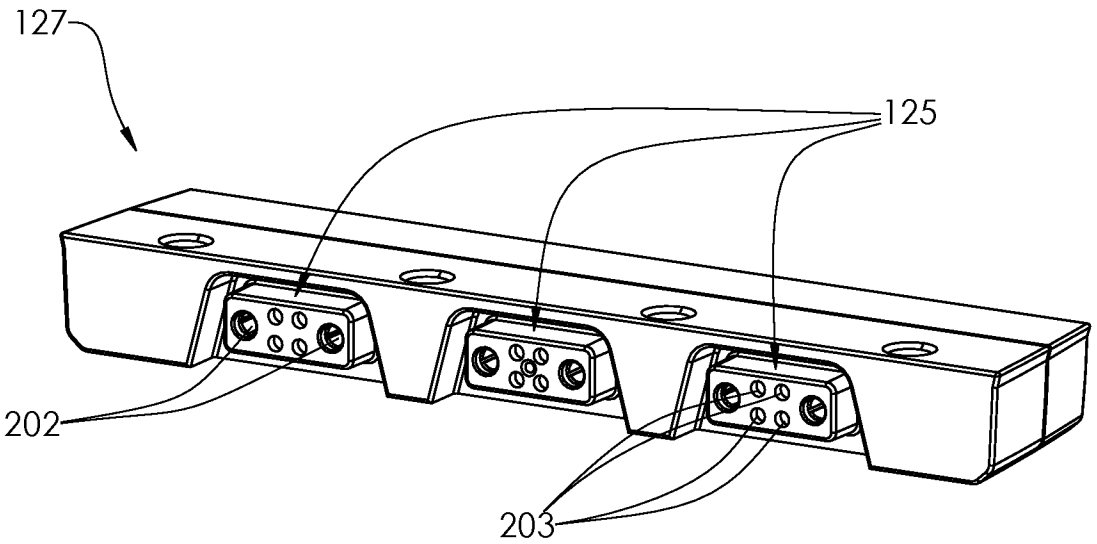
FIG. 18 is an isometric view of an exemplary bridge, similar to the bridge shown in FIG. 17, accordance with an embodiment of the present invention.

FIG. 18 is an isometric view of an exemplary bridge 127. The bridge 127 has one or more connector ports 125, each having power 202 and communication 203 couplers. In one embodiment, the middle port of the bridge 127 can be used to connect a single battery pack assembly 108 to a single controller assembly 107. In another embodiment, the left and right ports of the bridge 127 are used to connect two battery pack assemblies 108 to two controller assemblies 107. FIG. 17 is an isometric-sectional view of an exemplary powerpack including two battery pack assemblies 108*a*, 108*b*; two controller assemblies 107*a*, 107*b*; and a bridge 127.

Figure 20:
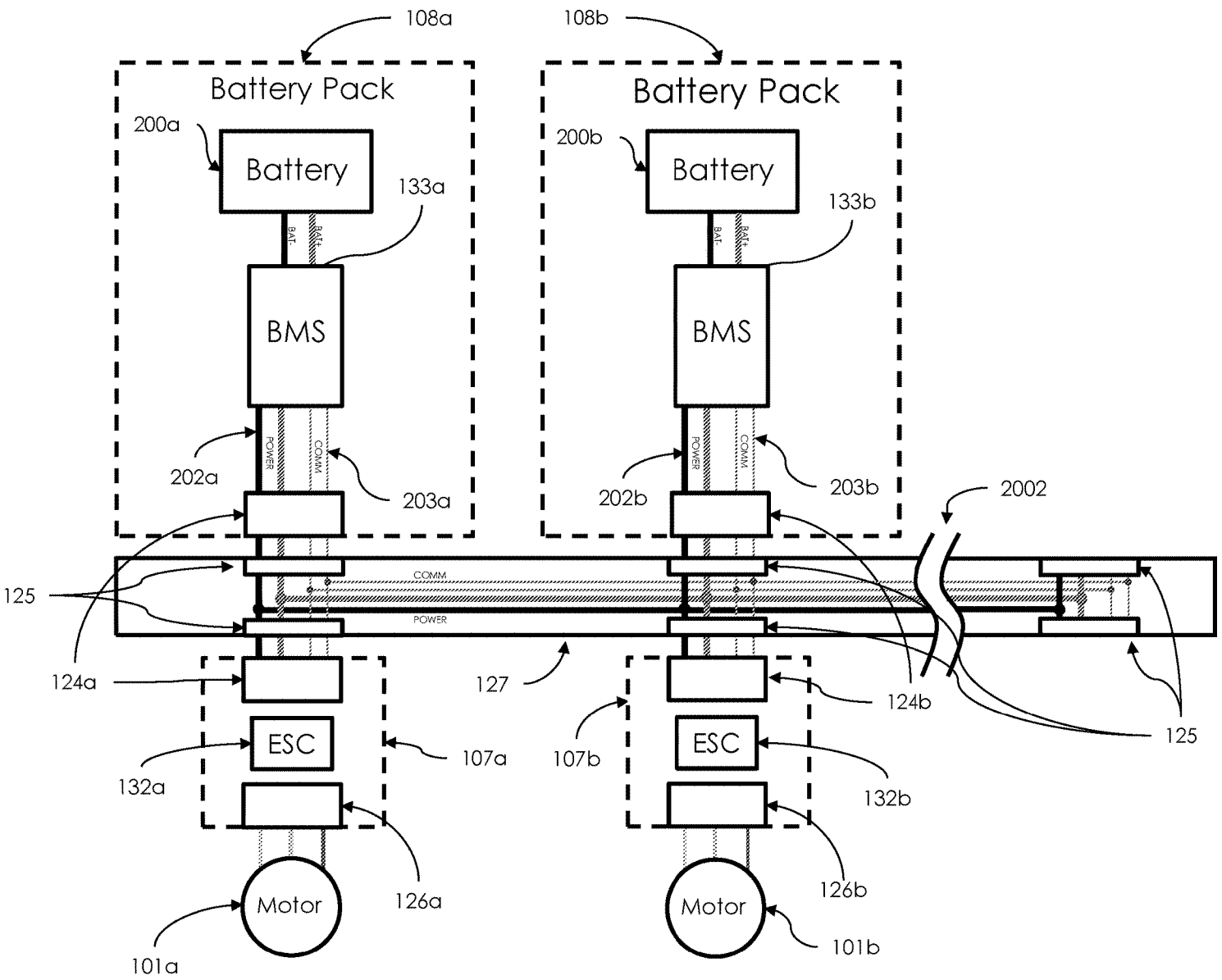
FIG. 20 is a diagram of an exemplary multi-powerpack modular architecture including two battery pack assemblies, two controller assemblies, and a bridge in accordance with an embodiment of the present invention.

FIG. 20 is a diagram of an exemplary multi-powerpack modular architecture including two battery pack assemblies 108*a*, 108*b*; two controller assemblies 107*a*, 107*b*; and a bridge 127. Note that the break 2002 in the bridge indicates any number of battery pack assemblies 108 may be coupled to any number of controller assemblies 107 via the bridge 127. For example, a large personal transportation vehicle may accommodate an increased number of battery pack assemblies as compared to a smaller vehicle. The bridge 127, in this example, can be configured to include as many connector ports 125 as desired.

Battery Management Process

In some exemplary embodiments, the BMS 133 can be configured to protect the battery 200 to which it is coupled. In some embodiments, BMS 133 continually or intermittently checks the states of charge of the batteries in the powerpack to ensure safe operation. In some embodiments, BMS 133 checks continually or intermittently for any added or subtracted batteries, as described in the scenarios above. In some embodiments, each BMS 133 keeps the power port of its respective battery 200 shut off unless certain safety checks have been performed.

Figure 21:
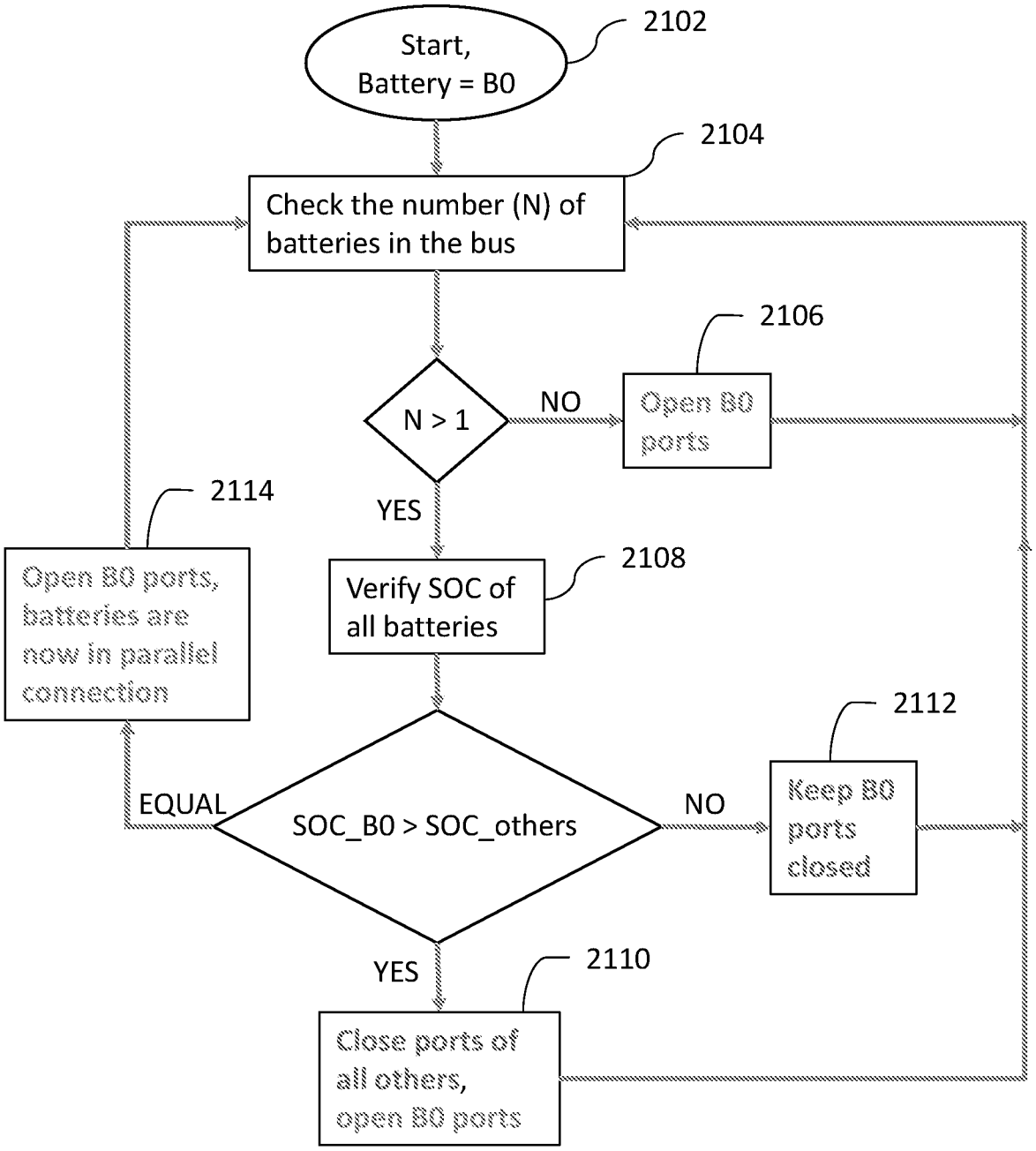
FIG. 21 is a flowchart of an exemplary process for a BMS in managing one or more coupled batteries in a modular powerpack accordance with an embodiment of the present invention.

FIG. 21 is a flowchart of an exemplary process for a BMS 133 in managing one or more coupled battery packs 108 in a modular powerpack. In the following example, BMS 133 is coupled a battery B0 (as indicated at the start position 2102). In process 2104, BMS 133 determines the number N of battery packs 108 are in the powerpack by communicating via the communication pin(s) 203 in the connector port 124. If Nis equal to one (N=1), at process 2106, the power ports of battery B0 are opened (e.g., a switch completes a power path between the battery and its destination). This allows for battery to be used in normal operation to power the controller assembly 107 and wheel-motor 101. If N is greater than one (N>1), at process 2108, BMS 133 verifies that state of charge (SOC) of each battery in the powerpack. If the SOC of battery B0 is greater than the SOC of the other battery or batteries (SOC_B0>SOC_other(s)), at process 2110, the port(s) of the other battery or batteries are closed and the port of battery B0 is opened. If the SOC of battery B0 is less than the SOC of the other battery or batteries (SOC_B0<SOC_other(s)), at process 2112, the port of battery B0 remains closed while the other battery or batteries discharge to the level of battery B0. If the SOC of battery B0 is approximately equal SOC of the other battery or batteries (SOC_B0≈SOC_SOC_other(s)), at process 2114, the ports of battery B0 and the other battery or batteries are opened and connected in parallel. In an exemplary embodiment, the BMS 133 is configured to manage two or more battery pack 108 such that a first battery with a higher SOC can charge a second battery with a lower SOC. This configuration entails that the ports of the batteries are open and thus, the BMS 133 is configured to safely manage the charging of one battery pack by another battery pack.

Aspects of the present invention may be embodied in many different forms, including, but in no way limited to, computer program logic for use with a processor (e.g., a microprocessor, microcontroller, digital signal processor, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof.

Computer program logic implementing all or part of the functionality previously described herein may be embodied in various forms, including, but in no way limited to, a source code form, a computer executable form, and various intermediate forms (e.g., forms generated by an assembler, compiler, networker, or locator.) Source code may include a series of computer program instructions implemented in any of various programming languages (e.g., an object code, an assembly language, or a high-level language such as Fortran, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies, networking technologies, and internetworking technologies. The computer program may be distributed in any form as a removable storage medium with accompanying printed or electronic documentation (e.g., shrink wrapped software or a magnetic tape), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL).

While the invention has been particularly shown and described with reference to specific embodiments, it will be understood by those skilled in the art that various changes in form and detail may be made therein without departing from the spirit and scope of the invention as defined by the appended clauses. While some of these embodiments have been described in the claims by process steps, an apparatus comprising a computer with associated display capable of executing the process steps in the claims below is also included in the present invention. Likewise, a computer program product including computer executable instructions for executing the process steps in the claims below and stored on a computer readable medium is included within the present invention.

What is claimed is:

1. A motorized wheel system for replacing a conventional wheel of a conventional skateboard, the skateboard having a truck with an axle on which is mounted the conventional wheel, the axle extending from an end of the truck so as to form a shoulder of the truck and having an outside end thereof, the wheel retained on the axle by an end nut removably attachable to the outside end of the axle, the system comprising:

a motor shaft having an axial bore therethrough, the bore sized to make the motor shaft concentrically and removably mountable on the axle, wherein the motor shaft has an exterior end formed in an open cylindrical shape, the exterior end sized to provide access to the outside end of the axle, the exterior end including an axially displaced shoulder sized to receive and abut the end nut, by which the motor shaft is secured on the axle;

a coupler having an axial bore therethrough, positionable over the axle, having an interior face configured to abut the shoulder of the truck and an exterior face configured to be coupled to the motor shaft, wherein the coupler is shaped to transmit torque from the motor shaft to the truck axle;

a stator assembly fixedly mounted concentrically around the motor shaft;

a rotor assembly having a permanently magnetized housing rotatably mounted concentrically outside of the stator assembly; and a tire mounted concentrically outside of and coupled to the rotor assembly;

wherein (i) the motor shaft, stator assembly, and rotor assembly form components of a DC brushless motor; (ii) the wheel system is mountable on the truck axle of the conventional skate board by the end nut, and (iii) tightening the end nut increases friction associated with the mechanical coupling of the motor shaft to the truck axle through the coupler.

2. A motorized wheel system according to claim 1, wherein the coupler is a clamping cone having an axially disposed slit to allow for radial expansion and contraction of the cone, and the portion of the motor shaft abutting the coupler has a corresponding female conical cut to mate with the clamping cone, and the tightening of the end nut urges the motor shaft axially to force the corresponding female conical cut to engulf an increasing amount of the clamping cone and to urge the clamping cone axially against the truck shoulder while producing a radial force between the clamping cone and the truck axle.

3. A motorized wheel system according to claim 1, wherein the coupler is a compression washer.

4. A motorized wheel system according to claim 1, wherein the coupler is a toothed washer.

5. A motorized wheel system according to claim 1, wherein the coupler is a splined washer.

6. A motorized wheel system according to claim 1, wherein the motor shaft has an interior end formed in an open cylindrical shape, the interior end sized to fit over a portion of the truck abutting the truck shoulder and sized to provide an interior wall having clearance over common truck size ranges.

7. A motorized wheel system according to claim 1, further comprising a first electronic controller coupled to the stator assembly, wherein the first electronic controller is configured to drive the stator assembly.

8. A motorized wheel system according to claim 7, wherein the first electronic controller is configured to drive the stator assembly via a three-phase connector.

9. A motorized wheel system according to claim 7, further comprising a first battery pack assembly, coupled to the first electronic controller and configured to provide power to the first electronic controller.

10. A motorized wheel system according to claim 8, wherein the first battery pack assembly comprises a battery management system coupled to a battery, the battery management system configured to monitor a charge level of the battery.

11. A motorized wheel system according to claim 8, further comprising a bridge configured to couple a power signal, a data signal, or a combination of a power signal and data signal between the first electronic controller and first battery pack assembly.

12. A motorized wheel system according to claim 11, further comprising a second battery pack assembly coupled to the bridge, wherein the bridge is configured to couple a power signal, a data signal, or a combination of a power signal and data signal between the second battery pack assembly, the first electronic controller, and the first battery pack assembly.

* * * * *